US009988726B1

(12) United States Patent
Alkhathlan et al.

(10) Patent No.: US 9,988,726 B1
(45) Date of Patent: Jun. 5, 2018

(54) METHOD OF PROTECTING METAL FROM CORROSION USING PLANT DERIVED ANTI-CORROSION AGENT

(71) Applicant: KING SAUD UNIVERSITY, Riyadh (SA)

(72) Inventors: Hamad Zaid Alkhathlan, Riyadh (SA); Merajuddin Khan, Riyadh (SA); Mahmood M. S. Abdullah, Riyadh (SA); Abdullah Mohammed Al-Mayouf, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days. days.

(21) Appl. No.: 15/788,555

(22) Filed: Oct. 19, 2017

(51) Int. Cl.
*C23F 11/00* (2006.01)
*C23F 11/04* (2006.01)
*B08B 9/00* (2006.01)

(52) U.S. Cl.
CPC ..... *C23F 11/04* (2013.01)

(58) Field of Classification Search
CPC ..... A01N 55/02; A01N 43/16; A01N 43/78
USPC ..... 422/7, 12; 134/22.1; 424/400
See application file for complete search history.

(56) References Cited

U.S. PATENT DOCUMENTS 6,300,370 B1 * 10/2001 Carle ..... A61K 36/28 424/725

FOREIGN PATENT DOCUMENTS

CN 103481718 A 1/2014
CN 103622871 A 3/2014

OTHER PUBLICATIONS

Pp. 1-5 of Nasibi et al., (Chamomile (*Matricaria recutita*) Extract as Corrosion Inhibitor for Mild Steel in Hydrochloric Acid Solution, Chemical Engineering Communications, vol. 200, 2013—Issue 3, pp. 367-378, Published online:Nov. 28, 2012.*
The specification. Applicant Admitted Prior Art [0010-0016].*
Nasibi et al., "Chamomile (*Matricaria recutita*) Extract as a Corrosion Inhibitor for Mild Steel in Hydrochloric Acid Solution," Chemical Engineering Communications, vol. 200, 2013—Issue 3, pp. 367-378, Published online: Nov. 28, 2012.

* cited by examiner

*Primary Examiner* — Monzer R Chorbaji
(74) *Attorney, Agent, or Firm* — Richard C. Litman

(57) ABSTRACT

Extracts of *Matricaria aurea* flowers are shown to exhibit anticorrosive activity when used with mild steel in acidic media. A process is shown for obtaining such anticorrosive extracts from the flowers of *M. aurea*. In particular, certain methanolic, aqueous methanolic and water extracts, as well as ethyl acetate and n-butanol fractions, of *M. aurea* flowers are shown to demonstrate particular anticorrosive activity when used with mild steel in acidic media. An isolated flavonoid compound from *M. aurea* flowers, designated as apigenin-7-O-β-D-glucoside, is particularly useful for anticorrosive activity when used with mild steel in acidic media.

3 Claims, 7 Drawing Sheets

METHOD OF PROTECTING METAL FROM CORROSION USING PLANT DERIVED ANTI-CORROSION AGENT

BACKGROUND OF THE INVENTION

1. Field of Invention

The present subject matter relates to anticorrosive activity in extracts of *Matricaria aurea* flowers, when used with metals, such as mild steel, in acidic media. The present subject matter further relates to a process for obtaining such anticorrosive extracts from the flowers of *M. aurea*. The present subject matter particularly relates to anticorrosive properties of apigenin-7-O-β-D-glucoside, an isolated flavonoid compound from *M. aurea*, when used with metal, such as mild steel, in acidic media.

2. Description of the Related Art

Corrosion is a destructive oxidative phenomenon associated with most metals. Generally, corrosion starts when metal comes in contact with the surrounding environment. Due to the negative effects of corrosion, it costs industry billions of dollars.

In a recent survey, it was estimated that the worldwide cost of corrosion is about 3.1-3.5% of the gross domestic product (GDP) annually. In industrial countries, such as the USA, it was estimated that the annual direct cost of corrosion is a staggering 276 billion USD—3.1% of the U.S. GDP. Another similar study conducted in other industrial countries such as China, Japan, the U.K., and Venezuela, demonstrated similar or even more costly results, leading to an estimated worldwide direct cost of corrosion exceeding 1.8 trillion USD.

Corrosion cannot be completely prevented, but it can be drastically reduced. Corrosion control and prevention can be achieved using various approaches including upgrading materials, blending production fluids, process control and chemical inhibition. Among these methods, the use of corrosion inhibitors typically is the most appropriate way to reduce or prevent corrosion.

In industry, mineral acids such as hydrochloric acid, sulphuric acid, nitric acid, and phosphoric acid often are employed during various processes including acid pickling, industrial cleaning, and petrochemical processes. These can lead to unwanted metal corrosion. Therefore, in order to minimize corrosion of industrial equipment and facilities, it is of immense importance to develop environmentally-friendly, practical and economical ways to protect metals from corrosion caused by acidic solutions.

Various corrosion inhibitors often are used to prevent or reduce metal corrosion. Corrosion inhibitors generally are chemicals that, when added in small amounts to the corrosive media, tend to decrease or prevent the reaction of metal in contact with the corrosive media, and consequently halt or mitigate corrosion of the metals. A compound which contains sulphur, phosphorous, nitrogen and oxygen atoms in their chemical structure was found to be more efficient as a corrosion inhibitor. Corrosion inhibitors can be prepared through chemical synthesis, or they can be obtained from natural sources—particularly from certain plants.

Varieties of synthetic compounds have shown good corrosion inhibition for metals. However, most of the synthetic corrosion inhibitors are found to be toxic and expensive. As a result, the popularity and use of synthetic compounds as corrosion inhibitors have diminished due to the adverse effects on the environment and its living inhabitants.

Accordingly, there exists a need to develop a new class of corrosion inhibitors with low toxicity. These inhibitors should be eco-friendly, while displaying good corrosion inhibition efficiency.

Humanity has used plants since ancient times for numerous purposes. Certain plants are known to be excellent sources of phytomolecules with diverse and complex chemical structures. Plants typically are biodegradable, easily accessible, renewable sources, that are usually economical and, most importantly, environmentally friendly.

In recent times, extracts of several plants and plant parts have been reported to show promising results against corrosion of metals. They have been found to be an excellent, environmentally benign, and economical source of corrosion inhibitors.

Moreover, U.S. patents have issued that cover certain uses of plant extracts as corrosion inhibitors for metals in various corrosive media. For example U.S. Pat. Nos. 5,435,941 and 6,602,555 to Fraunhofer et al., issued in 1995 and 2003, respectively, addressing use of tobacco extracts as efficient corrosion inhibitors for galvanic corrosion of metallic surfaces in sodium chloride solution. The patents state that the tobacco extracts were found to be more proficient corrosion inhibitors than a well-known corrosion inhibitor, potassium chromate, under the same conditions.

U.S. Pat. No. 8,926,867 issued to Gomes et al., in 2015. This patent describes the use of extracts from the skin of various fruits like cashew, passion-fruit, mango and orange as efficient corrosion inhibitors for various metals such as carbon steel 1020, copper, and copper alloy, in acidic, neutral, and alkaline medium.

U.S. Patent Application Publication No. 2008/0163796 A1, to Fraunhofer et al., published in 2008, reports the use of dried tobacco stems, leaves, and dust as useful corrosion inhibitor for steel embedded in Portland cement. The application states that addition of dried and ground tobacco stems, leaves, or dust to cementitious material results in excellent corrosion protection for steel. It also notes that such tobacco products are cheap, renewable corrosion inhibitors that provide corrosion protection with little or no environmental concerns.

*Matricaria aurea* (*M. aurea*) is an important medicinal and aromatic plant belonging to the family Asteraceae. *M. aurea* is well-known around the world for its medicinal and fragrant properties. Abundantly available in many parts of the Kingdom of Saudi Arabia, it is locally known as "Babunaj." Babunaj is frequently used by locals in the Kingdom for preparing herbal tea. *M. aurea* has also been widely used as herbal medicine for the treatment of various diseases such as colds, coughs, stomach, chest, and abdominal pain and sore throat. It has also been used as an antispasmodic, antiasthma, anti-infective, and analgesic agent.

Various plant species in the genus *Matricaria* are associated with large numbers of bioactive phytomolecules, such as α-bisabolol, herniarin, chlorogenic acid, naringenin, quercetin, apigenin, rutin, luteolin, umbelliferone, caffeic acid, and various flavonoid glycosides. However, very limited numbers of phytoconstituents, such as bisabolenes and acetylene, have been reported from *M. aurea*. Extracts of *M. aurea* and compounds isolated from those extracts were not previously reported to demonstrate corrosion inhibition properties.

As mentioned above, several plant extracts have been reported to exhibit efficient corrosion inhibition properties for metals in various aggressive media. However, most of these scientific studies described the corrosion inhibition activity of plant extracts. The main lead compound itself of the extract responsible for green corrosion inhibition usually is not identified.

In light of the history described above, anticorrosive extracts and fractions for metal, including mild steel, in acidic media, and methods of their isolation, are needed in the industry.

SUMMARY OF THE SUBJECT MATTER

The present subject matter provides various extracts, fractions, or compounds isolated from *Matricaria* plants that are effective corrosion inhibitors for metal in an acidic environment, and methods of isolating such extracts, fractions, or compounds.

One embodiment provides an extract, fraction, or compound from *Matricaria aurea* plants or plant parts that inhibits or prevents corrosion of metal in an acidic environment.

Another embodiment provides a method of isolating such an extract, fraction, or compound from *Matricaria aurea.*

Another embodiment provides a method of using an extract, fraction, or compound isolated from *Matricaria aurea* to inhibit or prevent metal corrosion in an acidic environment.

Another embodiment provides the compound of formula 1:

Formula 1

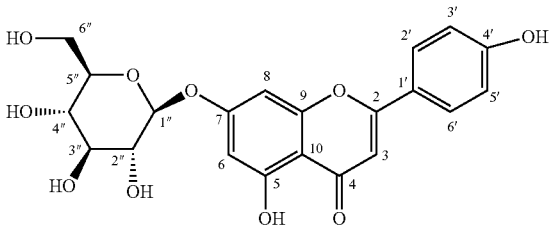

(apigenin-7-O-β-D-glucoside)

These and other features of the present invention will become readily apparent upon further review of the following specification and drawings.

DETAILED DESCRIPTION OF THE SUBJECT MATTER

Figure 1:
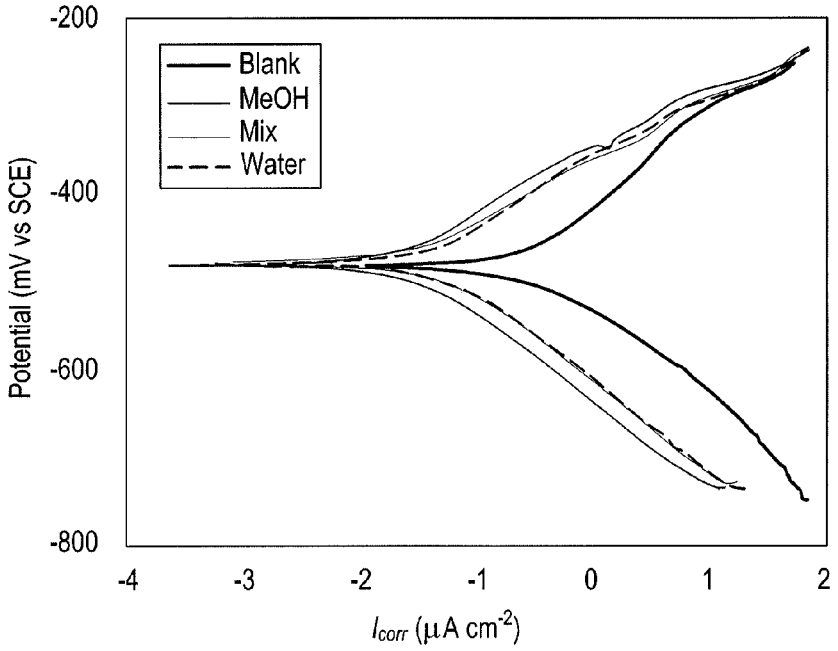
FIG. 1. Tafel plots for *M. Aurea* extracts in 1.0 M HCl: 600 ppm of MeOH, water, and mixture extracts.

A main objective of the present subject matter is to provide novel green anticorrosive agents from extracts and fractions of *M aurea* flowers, for use in preventing or reducing metal corrosion in acidic environments.

Another objective is to provide standardized anticorrosive herbal extracts and active fractions from *M. aurea* flowers.

Another objective is to provide a process for the preparation of anticorrosive herbal extracts and fractions from *M. aurea* flowers.

Still another object of the present invention is to isolate, characterize and establish anticorrosive properties of isolated active compounds from active fractions of *M aurea* flowers.

Still another objective is to demonstrate anticorrosive potential of isolated compounds from active fractions of *M aurea* flowers.

Various extracts of *M aurea* were screened for their corrosion inhibitive properties for mild steel in 1.0 M HCl, as demonstrated with Tafel plots measurements, linear polarization measurements, and electrochemical impedance spectroscopic (EIS) methods. All of the *M. aurea* extracts show good to significant corrosion inhibitive properties for mild steel in acidic media, typically with inhibition efficiencies of 80-87%.

Among these extracts, the methanol extract shows the highest corrosion inhibition efficiency. Active ingredients of the methanolic extract of *M. aurea* flowers were isolated and analyzed using an anticorrosive assay guided isolation and fractionation approach, leading to the isolation of the compound of formula 1, which was characterized as apigenin-7-O-β-D-glucoside:

Formula 1

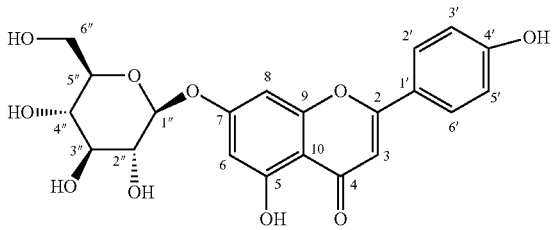

(apigenin-7-O-β-D-glucoside)

The structure was confirmed using various spectroscopic techniques including 1D and 2D NMR ($^{1}$H and $^{13}$C-NMR, DEPT, COSY, HMQC, HSQC, NOESY and HMBC).

An exemplary method for preparation of standardized extracts and anticorrosive assay guided fractionation, isolation, and characterization of this compound from *M aurea*, and the corrosion inhibitive efficiency screening, is described below.

Exemplary Process for Preparation of Extracts, Fractions, and Compounds

One embodiment of the process for preparation of bioactive extract and its fractions, and isolation of the compound of formula 1, includes the following steps:

(1) drying the plant part of *Matricaria;*

(2) powdering the plant part of *Matricaria;*

(3) extracting the plant powder of step (2) by soaking at room temperature in a non-polar solvents comprising petroleum ether, dichloromethane and benzene/or mixture thereof three times for a period of 48 hrs each;

(4) filtering the resultant extracts of step (3);

(5) evaporating the solvent of step (4) under reduced pressure to obtain nonpolar solvent extract;

(6) extracting the plant material of step (4) by soaking at room temperature in a low molecular weight alcohol three times for a period of 48 hrs each;

(7) filtering the alcoholic extract of step (6);

(8) evaporating the solvent of step (7) under reduced pressure to obtain an alcoholic extract;

(9) extracting the plant material of step (7) by soaking at room temperature in a mixture of low molecular weight alcohol and water in the ratio of 80:15 three times for a period of 48 hrs each;

(10) filtering the resultant extract of step (9);

(11) evaporating the solvent of step (10) under reduced pressure to obtain an alcoholic aqueous (85:15) extract;

(12) extracting the plant material of step (10) by soaking at room temperature in a polar solvents such as water, acetonitrile and low molecular alcohols/or mixtures thereof single times for a period of 16 hrs;

(13) filtering the resultant extract of step (12);

(14) evaporating the solvent of step (13) under reduced pressure to obtain a highly polar extract;

(15) testing the corrosion inhibitive properties of extracts as obtained from steps (8), (11) and (14) for metals in acidic aggressive media to identify most active corrosion inhibitive extracts;

(16) Most active corrosion inhibitive extract as obtained from step (15) is dissolved in water and partitioned with nonpolar, medium polar and polar organic solvents such as petroleum ether, benzene, dichlormethane, dichloroethane, tetrachloromethane, chloroform, ethyl acetate and n-butanol (saturated with water);

(17) washing all organic fractions as obtained in step (16) with water except n-butanol fraction, drying them over anhydrous sodium sulphate and removing the solvent under vacuum to obtain their respective dried fractions;

(18) testing the corrosion inhibitive properties of all (medium polar and polar) fractions as obtained from steps (17) for metals in acidic aggressive media to identify most active corrosion inhibitive fraction using Tafel plots measurements, linear polarization measurements and electrochemical impedance spectroscopic (EIS) methods;

(19) Isolating the pure lead compound responsible for corrosion inhibitive action for metals in acidic media from the most active fraction as obtained from step (18) using column chromatography (CC)/thin layer chromatography (TLC);

(20) silica gel, sephadex LH-20 and/or aluminium oxide is used as stationary phase whereas petroleum ether, DCM, $CHCl_3$, EtOAc, MeOH and water/or mixtures thereof are used as mobile phase.

(21) TLC profiles of each collected fractions are verified on pre-coated silica gel 60 F254 (0.2 mm, Merck) plates, and their spots are detected using a CAMAG viewing chamber, which is fitted with a UV lamp;

(22) Similar fractions were pooled together based on their TLC profiles as: Fr(s) 14-27 (MA-1), Fr(s) 30-37 (MA-2), Fr(s) 50-55 (MA-3), Fr(s) 58-69 (MA-4). Among all of the pooled fractions, fraction AP-3 has the most potent anticorrosive activity for metals in acidic media;

(23) The TLC profile of the active subfraction MA-3 shows that this subfraction contains a flavonoidal compound as the major constituent (>90%);

(24) To purify this major compound, subfraction MA-3 is subjected to crystallization in methanol at room temperature, which isolated a pure potent anticorrosive agent of formula 1; and

(25) testing the corrosion inhibitive properties of compound of formula 1 as obtained from steps (17) in detail for metals in acidic aggressive media using weight loss, Tafel plots, linear polarization and electrochemical impedance spectroscopic (EIS) and SEM and EDS methods.

The following examples are given by way of illustration, and should not construed to limit the scope of the present invention.

Example-1

Collection and Identification of Plant Material

*M. aurea* flowers growing in Riyadh, Saudi Arabia, were purchased from a local herbal market at Batha, Riyadh, Saudi Arabia in February 2011. Identification of the plant species was confirmed by a plant taxonomist (Dr. Jacob Thomas Pandalayil) in the Herbarium Division, College of Science, King Saud University, Riyadh, KSA. A voucher specimen of the plant material is maintained in our laboratory with voucher specimen no. KSUHZK-303.

Example-2

Figure 2:
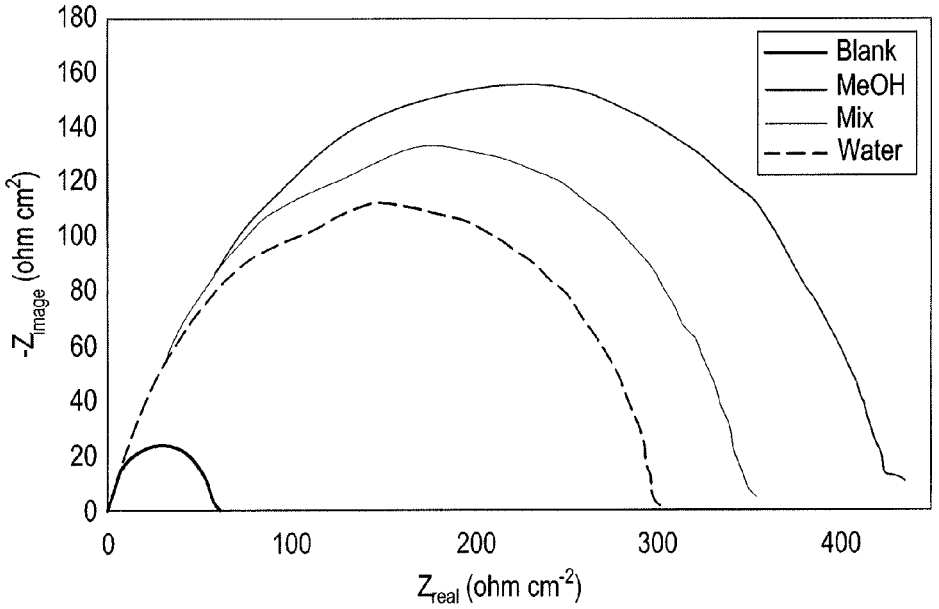
FIG. 2. Nyquist plots for *M. Aurea* extracts in 1.0 M HCl: 600 ppm of MeOH, water, and mixture extracts.

Extraction and Fractionation of Plant Material; Evaluation of Corrosion Inhibitive Properties Shaded air-dried and powdered flowers (5.0 kg) of *M. aurea* were first defatted with n-hexane, three times at room temperature for 48 hours each time. Then, the defatted plant materials were extracted three times with methanol; followed by a mix of methanol:water (85:15) three times for 48 hours each; and finally with water overnight at room temperature. The combined methanolic, aqueous methanolic (mixture) and water extracts were separately concentrated in vacuum at 40° C. until solvents were completely removed. The resulting methanolic (950.0 g), aqueous methanolic (321.0 g), and water (250.0 g) extracts were screened for their anticorrosive properties using Tafel plots, linear polarization, and electrochemical impedance spectroscopic (EIS) methods. Results are provided given in Tables 1 and 2, and FIGS. 1 and 2.

TABLE 1

Potentiodynamic polarization parameters obtained from Tafel plots for the corrosion of mild steel in 1.0M HCl with 600 ppm of various extracts of *M. aurea*

| Inhibitors | $E_{corr}$ (mV) | $I_{corr}$ ($\mu Acm^{-2}$) | $\beta_a$ (mV/dec) | $\beta_c$ (mV/dec) | $R_p$ | IE % Tafel | IE % LPR |
|---|---|---|---|---|---|---|---|
| Blank | −486.6 | 213.0 | 99.85 | −110.73 | 54.5 | — | — |
| MeOH | −481.58 | 20.0 | 82.29 | −73.57 | 401.69 | 90.61 | 86.43 |
| Mixture MeOH: $H_2O$ (85:15) | −474.32 | 26.0 | 80.31 | −75.8 | 351.79 | 87.79 | 84.51 |
| Water | −482.16 | 35.0 | 87.42 | −74.12 | 271.26 | 83.57 | 79.91 |

TABLE 2

Electrochemical impedance parameters obtained from Nyquist plots for mild steel in 1.0M HCl with 600 ppm of various extracts of *M. aurea*

| Inhibitors | $R_{ct}$ ($\Omega$ $cm^2$) | $C_{dl}$ ($\mu F$ $cm^{-2}$) | θ | IE % |
|---|---|---|---|---|
| Blank | 57.1 | 533.0 | — | — |
| MeOH | 412.7 | 121.0 | 0.86 | 86.16 |
| Mixture MeOH: $H_2O$ (85:15) | 372.25 | 170.0 | 0.85 | 84.66 |
| Water | 302.0 | 200.0 | 0.81 | 81.09 |

Figure 3:
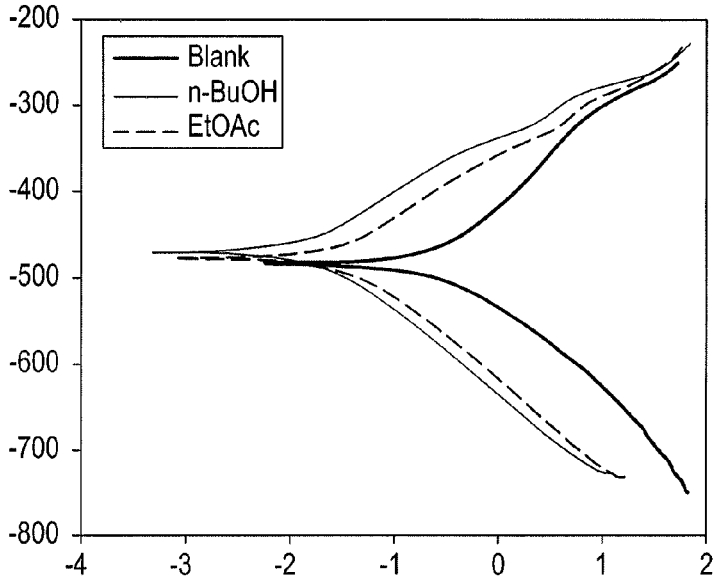
FIG. 3. Tafel plots for *M. Aurea* extracts in 1.0 M HCl: n-BuOH and EtOAc extracts.

These results indicate that the methanolic extract has the highest inhibitive efficiency. The methanolic extract dissolved in distilled water, and was successively partitioned with n-hexane, chloroform, ethyl acetate and water-saturated n-butanol, to yield soluble fractions of n-hexane (193.0 g), chloroform (93.0 g), ethyl acetate (31.2 g) and n-butanol (75.0 g). The ethyl acetate and n-butanol fractions subsequently were tested for anticorrosive properties using Tafel plots, linear polarization, and electrochemical impedance spectroscopic (EIS) methods. The results are provided in Tables 3 and 4, and FIGS. 3 and 4. The n-hexane and chloroform fractions were not soluble in 1.0 M HCl solutions, and so were not tested for their anticorrosive properties.

These results demonstrate that both ethyl acetate and n-butanol fractions show promising anticorrosive properties, while the n-butanol fraction is found to be more active. As a result, the n-butanol fraction was further subject to isolation and identification of its active anticorrosive agent.

Example-3

Isolation of Anticorrosive Compound from the n-Butanol Fraction of *M. aurea* Flowers The n-butanol (75.0 g) fraction was subject to TLC on a silica gel (60-120 mesh, 1100 gm) column, and gradient elution was applied using mixtures of chloroform and methanol, with ratios of $CHCl_3$:MeOH of 92:8, 88:12, 80:20, 60:40, and 58:42. In total, 81 fractions (500 mL each) were collected. The TLC profiles were verified on precoated silica gel 60 F254 (0.2 mm, Merck) plates, and their spots were detected using a CAMAG viewing chamber, fitted with a UV lamp. Similar fractions were pooled together based on their TLC profiles as: Fr(s) 11-13 (MA-1), Fr(s) 15-19 (MA-2), Fr(s) 28-34 (MA-3), Fr(s) 41-81 (MA-4).

Figure 5:
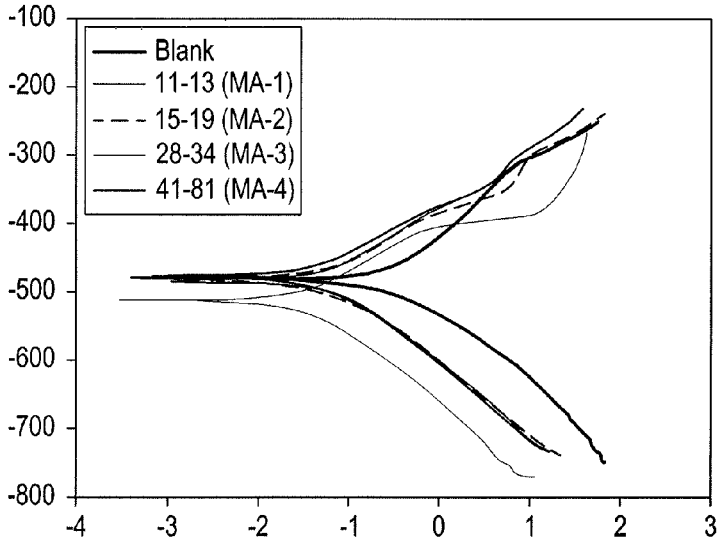
FIG. 5. Tafel plots for various fractions of n-BuOH extracts of *M. aurea* in 1.0 M HCl.
Figure 6:
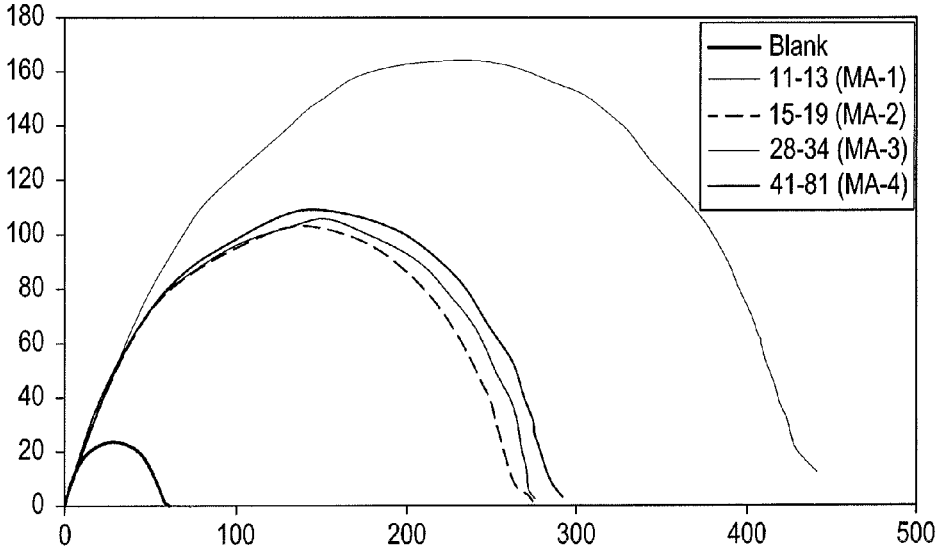
FIG. 6. Nyquist plots for various fractions of n-BuOH extracts of *M. aurea* in 1.0 M HCl.

All pooled column fractions were tested for their anticorrosive properties for mild steel in 1.0 M HCl medium. The results are reported in Tables 5 and 6, and FIGS. 5 and 6.

TABLE 3

Potentiodynamic polarization parameters from Tafel plots for the corrosion of mild steel in 1M HCl with 60 mg/100 ml of *M. aurea* extracts

| Extracts | $E_{corr}$ (mV) | $I_{corr}$ ($\mu Acm^{-2}$) | $\beta_a$ (mV/dec) | $\beta_c$ (mWdec) | $R_p$ | E (%) Tafel | E (%) LPR |
|---|---|---|---|---|---|---|---|
| 1M HCl | −486.6 | 213.0 | 99.85 | −110.73 | 54.5 | — | — |
| n-BuOH extract | −468.62 | 14.7 | 80.61 | −80.31 | 585.62 | 93.10 | 90.69 |
| EtOAc extract | −478.65 | 27.8 | 82.45 | −78.59 | 334.37 | 86.95 | 83.70 |

TABLE 4

Electrochemical impedance parameters from Nyquist plots for mild steel in 1.0M HCl with 600 ppm of *M. aurea* various extracts

| Extract | $R_{ct}$ ($\Omega$ $cm^2$) | $C_{dl}$ ($\mu F$ $cm^{-2}$) | θ | E (%) |
|---|---|---|---|---|
| 1M HCl | 57.10 | 533.0 | — | — |
| n-BuOH extract | 580.6 | 98.0 | 0.91 | 90.17 |
| EtOAc extract | 364.0 | 158.0 | 0.84 | 84.31 |

TABLE 5

Potentiodynamic polarization parameters from Tafel plots for the corrosion of mild steel in 1.0M HCl with 600 ppm of various fractions of *M. aurea* n-BuOH extracts

| Extracts Mg/100 ml | $E_{corr}$ (mV) | $I_{corr}$ ($\mu Acm^{-2}$) | $\beta_a$ (mV/dec) | $\beta_c$ (mV/dec) | $R_p$ ($\Omega$ $cm^2$) | E (%) Tafel | E (%) LPR |
|---|---|---|---|---|---|---|---|
| 1M HCl | −486.6 | 213.0 | 99.85 | −110.73 | 54.5 | — | — |
| 11-13 | −484.77 | 41.0 | 74.97 | −67.91 | 251.99 | 80.75 | 78.37 |
| 15-19 | −481.75 | 31.0 | 70.48 | −68.19 | 274.41 | 85.45 | 80.14 |
| 28-34* | −511.52 | 19.24 | 68.33 | −68.32 | 395.29 | 90.97 | 86.21 |
| 41-81 | −477.19 | 30.0 | 71.99 | −69.26 | 294.31 | 85.92 | 81.48 |

TABLE 6

Electrochemical impedance parameters from Nyquist plots for mild steel in 1.0M HCl with 600 ppm of various fractions of *M. aurea* n-BuOH extracts

| Extract | $R_{ct}$ ($\Omega$ $cm^2$) | $C_{dl}$ ($\mu F$ $cm^{-2}$) | θ | E (%) |
|---|---|---|---|---|
| 1M HCl | 57.10 | 533.0 | — | — |
| 11-13 | 265.1 | 200 | 0.78 | 78.46 |
| 15-19 | 284.15 | 185 | 0.80 | 79.90 |
| 28-34* | 436 | 171.5 | 0.87 | 86.90 |
| 41-81 | 320.3 | 200.0 | 0.82 | 82.17 |

The results demonstrate that fraction MA-3 has the most potent anticorrosive activity for mild steel in acidic media. The TLC profile of the active subfraction MA-3 shows that this subfraction contains a flavonoid compound as the major constituent (>90%). To purify this major compound, subfraction MA-3 was subjected to crystallization in methanol at room temperature. This isolated the pure potent anticorrosive compound of formula 1:

Formula 1

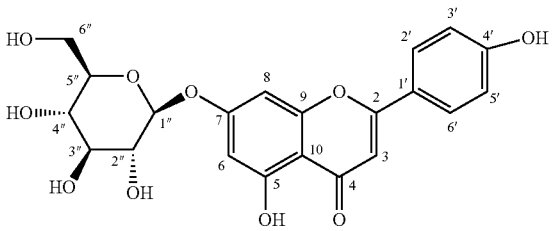

(apigenin-7-O-β-D-glucoside)

Example-4

Determination of Optimum Inhibitor Concentration of Compound of Formula 1

The optimum inhibitor concentration of the compound of formula 1, for inhibition efficiency of mild steel in 1.0 M HCl, was determined using a weight loss experiment at 298±1 K for an immersion period of 3 h. The resulting percentage inhibition efficiency (IE %), corrosion rate, and surface coverage (θ) are summarized in Table 7.

TABLE 7

Inhibition efficiency, weight loss, surface coverage and corrosion rate at different concentrations of compound of formula 1 for mild-steel corrosion in 1.0M HCl from weight loss measurements at 298 ± 1K.

| Concentration of inhibitor (mM) | Weight loss (g) | Surface coverage (θ) | Corrosion rate $C_R$ (mm $year^{-1}$) | IE % |
|---|---|---|---|---|
| 0 (blank) | 0.2587 | — | 0.1327 | — |
| 0.116 | 0.0370 | 0.86 | 0.0194 | 85.70 ± 0.84 |
| 0.232 | 0.0304 | 0.88 | 0.0159 | 88.25 ± 0.98 |
| 0.348 | 0.0243 | 0.91 | 0.0127 | 90.61 ± 0.83 |
| 0.464 | 0.0161 | 0.94 | 0.0084 | 93.78 ± 0.91 |
| 0.580 | 0.0158 | 94 | 0.0083 | 93.89 ± 0.95 |

Figure 7:
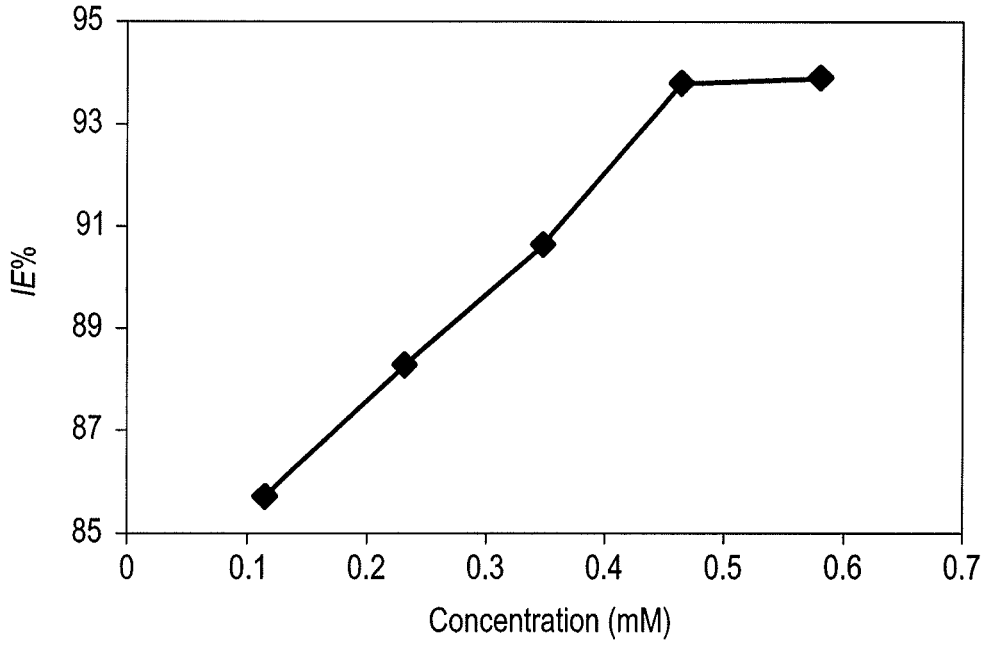
FIG. 7. Chart plotting inhibition efficiency vs. various concentrations of compound of formula 1.
Figure 8A:
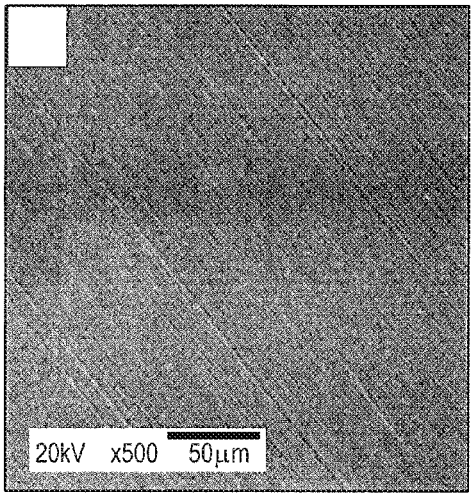
FIG. 8A is a SEM image of polished mild-steel coupon.
Figure 8B:
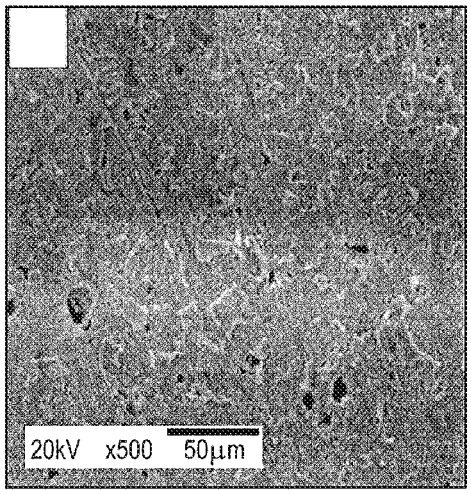
FIG. 8B is a SEM image of mild-steel coupon in 1.0 M HCl.
Figure 8C:
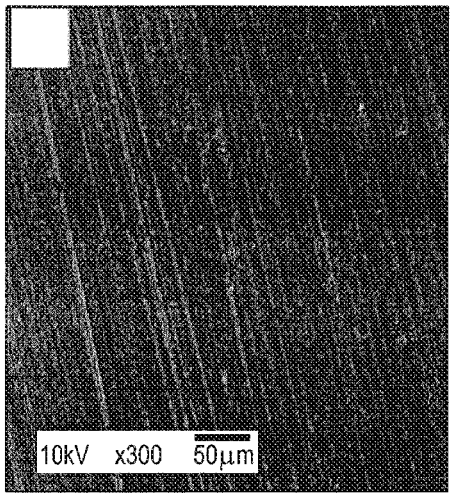
FIG. 8C is a SEM image of mild-steel coupon with 0.446 mM of compound of formula 1 in 1.0 M HCl.
Figure 9A:
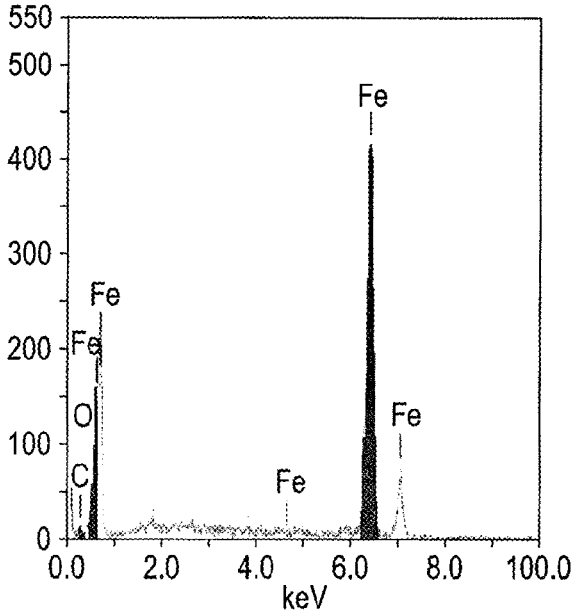
FIG. 9A is an EDS of polished mild-steel coupon.
Figure 9B:
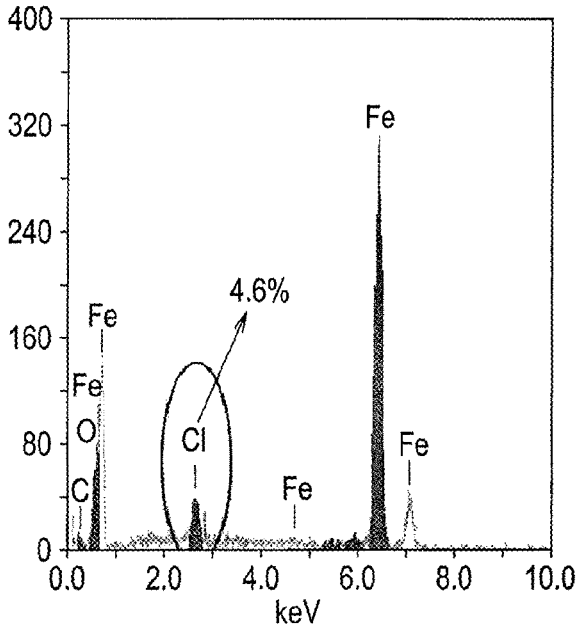
FIG. 9B is an EDS of mild-steel coupon in 1.0 M HCl.
Figure 9C:
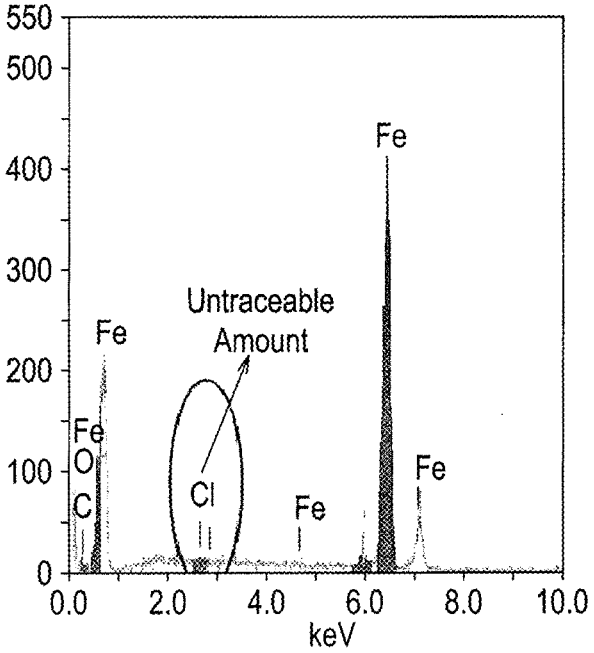
FIG. 9C is an EDS of mild-steel coupon with 0.464 mM of compound of formula 1 in 1.0 M HCl.

FIG. 7 shows the effects of inhibitor concentrations on inhibition efficiency of mild steel in 1.0 M HCl solution.

Figure 4:
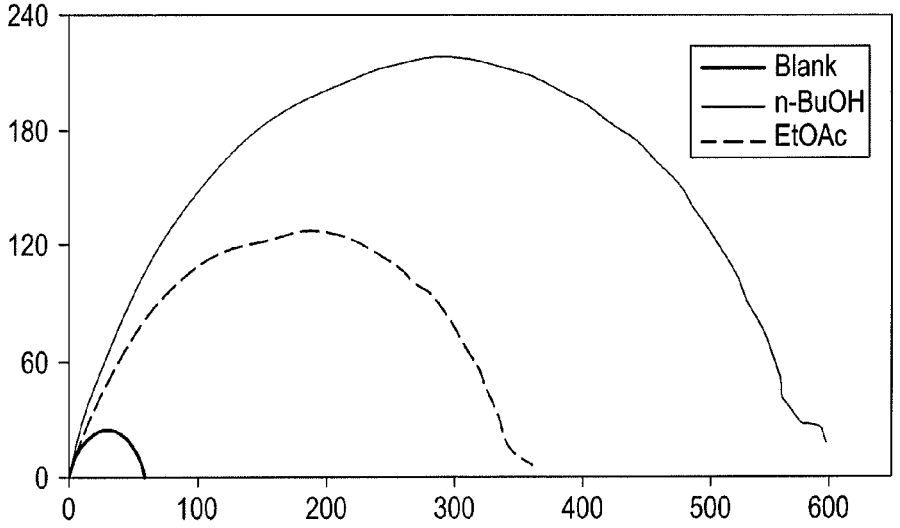
FIG. 4. Nyquist plots for *M. Aurea* extracts in 1.0 M HCl: n-BuOH and EtOAc extracts.

These results in Table 7 and FIG. 7 demonstrate that the highest inhibition efficiency for the compound of formula 1 is obtained by a concentration of about 0.464 mM. Further increases in the inhibitor concentration do not significantly change the protective effect of the green inhibitor (FIG. 4). Therefore, 0.464 mM was considered to be the optimal concentration for this green anticorrosive compound of formula 1.

Example-5

Physical and Spectroscopic Analysis of the Isolated Compounds

Melting points were determined on a Gallenkamp melting point apparatus; the results were uncorrected. NMR spectra (1D and 2D) were recorded with a JEOL ECP-400 spectrometer. The NMR samples were prepared in deuterated dimethyl sulfoxide-$d_6$ (DMSO-$d_6$) with tetramethylsilane (TMS) as an internal standard. The chemical shifts and coupling constants (J) are expressed in δ (ppm) and Hz, respectively. MS spectra were recorded on a Waters Acquity UPLC-MS/MS system, equipped with a TQD detector. The samples were infused as methanol-water solutions, using API-ESI ionization in either positive or negative mode.

Example-6

Chemical Structure Characterization of the Compound of Formula 1

Apigenin-7-O-β-D-glucoside: this compound was isolated as yellow amorphous powder; $C_{21}H_{20}O_{10}$; m.p. 235-239° C. ESI-MS (negative mode) m/z: 431 $[M-H]^-$. $^1$H-NMR (400 MHz, DMSO-$d_6$) δ (ppm): δ 7.92 (2H, d, J=8.5 Hz, H-2' & H-6'), 6.91 (2H, d, J=8.5 Hz, H-3' & H-5'), 6.83 (1H, s, H-3), 6.80 (1H, d, J=2.5 Hz, H-8), 6.42 (1H, d, J=2.5 Hz, H-6), 5.04 (1H, d, J=7.5, H-1"), 3.71 (1H, m, H-6"a), 3.47 (1H, m, H-6"b), 3.42 (1H, m, H-5"), 3.27 (1H, m, H-3"), 3.25 (1H, m, H-2"), 3.16 (1H, m, H-4"). $^{13}$C-NMR (100 MHz, DMSO-$d_6$) δ (ppm): δ 182.8 (s, C-4), 164.9 (s, C-2), 163.5 (s, C-7), 161.9 (s, C-5), 161.8 (s, C-4'), 157.5 (s, C-9), 129.8 (d, C-2' & C-6'), 121.8 (s, C-1'), 116.7 (d, C-3' & C-5'), 105.8 (s, C-10), 103.9 (d, C-3), 100.7 (d, C-1"), 100.0 (d, C-6), 95.3 (d, C-8), 77.9 (d, C-5"), 76.9 (d, C-3"), 73.6 (d, C-2"), 70.3 (d, C-4"), 61.2 (t, C-6").

The chemical structure was established as apigenin-7-O-β-D-glucoside using various spectroscopic techniques, such as 1D and 2D NMR ($^1$H and $^{13}$C NMR, DEPT, COSY, HMQC, HSQC, NOESY and HMBC).

Example-7

Electrochemical Studies

The electrochemical studies were performed in a conventional three-electrode cell assembly, at room temperature using a standard potentiostat equipped with an impedance spectra analyzer. This testing was performed after a steady open-circuit potential (OCP) was attained. This occurred in about 30 minutes.

Weight Loss Measurements

Mild steel specimens were accurately weighed on an analytical balance with an accuracy of 0.1 mg. The specimens were then completely immersed in an open beaker containing 100 mL of 1.0 M HCl, with and without various concentrations of inhibitor, at different temperatures 298±1 K for 3 h. Then, the specimens were removed, washed with distilled water, and completely dried using an air blower, before being accurately weighed. Inhibitor concentrations of 0.116-0.580 mM were tested.

SEM and EDS Analysis

Mild steel specimens were dipped in 100 mL of 1.0 M HCl without and with the optimal green inhibitor concentration of 0.464 mM, for 3 hours. Then, they were immediately rinsed with acetone, and maintained at room temperature until completely dry. The surface morphology of the specimens was examined using a JEOL-JSM-6380LA Scanning Electron Microscope (SEM-EDS), determining results for SEM and EDS analysis for freshly abraded mild-steel sample without treatment; mild steel sample that was treated in 1.0 M HCl for 3 hours in 1.0M HCl; and mild steel that was treated with an optimal concentration of inhibitor (0.464 mM) in 1.0 M HCl for 3 hours. Results are shown in FIGS. 8*a* to 8*c*, and 9*a* to 9c. These results demonstrate that this green corrosion inhibitor—the compound of formula 1—effectively protects mild steel from the corrosive solution.

It is to be understood that the present invention is not limited to the embodiments described above, but encompasses any and all embodiments within the scope of the following claims.

We claim:

1. A process for the preparation of the extract, fraction, or compound from *Matricaria aurea* flowers grown in Riyadh, Saudi Arabia, wherein the fraction is an n-butanol fraction obtained from a methanolic extract, exhibiting inhibition or prevention of metal corrosion in an acidic environment, further wherein the compound has the formula:

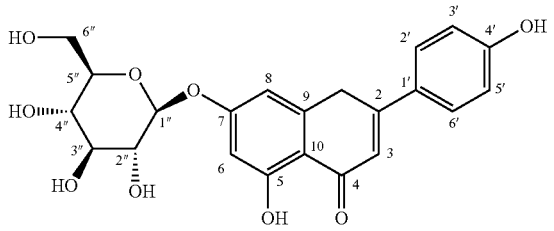

wherein the process comprises:

a) obtaining a plant powder from one or more plant parts of *Matricaria aurea;* b) subjecting the plant powder to at least one extraction in a non-polar solvent;

c) filtering the extracts of step b);

d) extracting the filtered material from step c) by soaking in a low molecular weight alcohol;

e) filtering the alcoholic extract of step d);

f) extracting the plant material of step e) by soaking in a mixture of low molecular weight alcohol and water;

g) filtering the resultant extract of step f);

h) extracting the plant material of step g) by soaking in a polar solvent;

i) filtering the resultant extract of step h);

j) evaporating the solvents of steps b), d), f) and h);

k) testing the corrosion inhibitive properties of all extracts;

l) selecting the desired extract obtained from step k), dissolving it in water, and partitioning with nonpolar, medium polar and polar organic solvents;

m) washing all organic fractions obtained in step l) with water, drying the fractions, and removing the solvent to obtain the respective dried fractions;

n) testing corrosion inhibitive properties of the fractions obtained from step m); and o) isolating a fraction or compound exhibiting inhibition or prevention of metal corrosion in an acidic environment.

2. The process of claim 1, wherein the isolated fraction or compound demonstrates corrosion inhibition efficiency ranging from 80-94% for metals in acidic media.

3. The process of claim 1, wherein the isolated fraction or compound is useful for inhibiting or preventing corrosion of metal selected from the group consisting of mild steel, carbon steel, copper, copper alloys, and mixtures thereof.

* * * * *